US010629144B2

(12) United States Patent
Kang

(10) Patent No.: US 10,629,144 B2
(45) Date of Patent: Apr. 21, 2020

(54) METHOD FOR DRIVING A DISPLAY APPARATUS, APPARATUS FOR DRIVING A DISPLAY APPARATUS, AND DISPLAY APPARATUS BY ADJUSTING A SECOND COLOR LUMINANCE RATIO LESS THAN FIRST AND THIRD RATIOS AT LARGE VIEWING ANGLES

(71) Applicants: HKC Corporation Limited, Shuitian Village, Shiyan Sub-district (CN); Chongqing HKC Optoelectronics Technology Co., Ltd., Chongqing (CN)

(72) Inventor: Chih-Tsung Kang, Chongqing (CN)

(73) Assignees: HKC CORPORATION LIMITED, Shenzhen, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 1 day.

(21) Appl. No.: 16/064,677

(22) PCT Filed: Jan. 23, 2018

(86) PCT No.: PCT/CN2018/073761
§ 371 (c)(1),
(2) Date: Jun. 21, 2018

(87) PCT Pub. No.: WO2019/119602
PCT Pub. Date: Jun. 27, 2019

(65) Prior Publication Data

US 2019/0206343 A1 Jul. 4, 2019

(30) Foreign Application Priority Data

Dec. 21, 2017 (CN) ..... 2017 1 1396609

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 3/3413* (2013.01);
(Continued)

(58) Field of Classification Search
CPC .. G09G 3/3648; G09G 3/3406; G09G 3/3413; G09G 3/3607; G09G 2300/0447;
(Continued)

(56) References Cited

U.S. PATENT DOCUMENTS

| | | | | |
|---|---|---|---|---|
| 7,259,769 | B2 * | 8/2007 | Diefenbaugh | G09G 3/3413 345/591 |
| 2009/0213053 | A1 * | 8/2009 | Naruse | G09G 3/3648 345/88 |

(Continued)

FOREIGN PATENT DOCUMENTS

| | | | |
|---|---|---|---|
| CN | 104517576 | A | 4/2015 |
| CN | 106157869 | A | 11/2016 |
| JP | 2008275855 | A | 11/2008 |

OTHER PUBLICATIONS

International Search Report and Written Opinion dated Oct. 8, 2018, in International Application No. PCT/CN2018/073761.

*Primary Examiner* — Darlene M Ritchie
(74) *Attorney, Agent, or Firm* — Muncy, Geissler, Olds & Lowe, P.C.

(57) ABSTRACT

This application relates to a method and an apparatus for driving a display apparatus and a display apparatus. The method for driving the display apparatus includes: calculating average signals of sub pixel units in a zone to obtain a zone first average signal, a zone second average signal, and a zone third average signal; first performing second gamma adjustment according to grayscale corresponding predefined
(Continued)

ranges of the first, second, and third average signals; allowing a second luminance ratio in a large viewing angle less than first and third luminance ratios in the large viewing angle, presenting a neutral color; and adjusting luminance of a corresponding second light source.

17 Claims, 7 Drawing Sheets

(52) U.S. Cl.
CPC ..... *G09G 2320/028* (2013.01); *G09G 2320/0276* (2013.01); *G09G 2320/068* (2013.01); *G09G 2320/0626* (2013.01); *G09G 2320/0666* (2013.01); *G09G 2320/0673* (2013.01)

(58) Field of Classification Search
CPC ... G09G 2300/0443; G09G 2320/0276; G09G 2320/0673; G09G 2320/028; G09G 2320/068; G09G 2320/0626
See application file for complete search history.

(56) References Cited

U.S. PATENT DOCUMENTS

2009/0289962 A1* 11/2009 Jun ..... G09G 3/3413 345/690
2011/0254879 A1* 10/2011 Mori ..... G09G 3/3607 345/690
2012/0086743 A1* 4/2012 Shiomi ..... G02F 1/136213 345/694
2014/0253422 A1* 9/2014 Tomizawa ..... G02F 1/133514 345/88
2015/0042691 A1* 2/2015 Gong ..... G09G 3/3413 345/690
2015/0221267 A1* 8/2015 Yoshida ..... G09G 3/3607 345/694
2017/0084232 A1* 3/2017 Yang ..... G09G 3/3426
2017/0110064 A1* 4/2017 Zhang ..... G09G 3/2018
2017/0154587 A1* 6/2017 Chen ..... G09G 3/2003
2017/0249890 A1* 8/2017 Yoo ..... G09G 3/2074
2017/0330520 A1* 11/2017 Tien ..... G09G 3/3607
2018/0211633 A1* 7/2018 Peng ..... G09G 5/10

* cited by examiner

METHOD FOR DRIVING A DISPLAY APPARATUS, APPARATUS FOR DRIVING A DISPLAY APPARATUS, AND DISPLAY APPARATUS BY ADJUSTING A SECOND COLOR LUMINANCE RATIO LESS THAN FIRST AND THIRD RATIOS AT LARGE VIEWING ANGLES

BACKGROUND

Technical Field

This application relates to a method for designing a display panel, and in particular, to a method and an apparatus for driving a display apparatus and a display apparatus.

Related Art

A liquid-crystal display (LCD) is a flat thin display apparatus, is formed by a number of color or black and white pixels, and is disposed in front of a light source or a reflecting surface. Each pixel is formed by the following parts: a liquid crystal molecular layer suspending between two transparent electrodes, and two polarization filters, with polarization directions perpendicular to each other, disposed on two outer sides. If there is no liquid crystal between the electrodes, when light passes through one of the polarization filters, a polarization direction of the light is completely perpendicular to the second polarization filter, and therefore the light is completely blocked. However, if the polarization direction of the light passing through one of the polarization filters is rotated by liquid crystals, the light can pass through the other polarization filter. Rotation of the polarization direction of the light by the liquid crystals may be controlled by means of an electrostatic field, so as to implement control on the light.

Before charges are applied to transparent electrodes, arrangement of liquid crystal molecules is determined by arrangement on surfaces of the electrodes. Surfaces of chemical substances of the electrodes may be used as seed crystals of crystals. In most common twisted nematic (TN) liquid crystals, two electrodes above and below liquid crystals are vertically arranged. Liquid crystal molecules are arranged in a spiral manner. A polarization direction of light passing through one of polarization filters rotates after the light passes through a liquid crystal sheet, so that the light can pass through the other polarization filter. In this process, a small part of light is blocked by the polarization filter, and pixels look gray when seen from outside. After the charges are applied to the transparent electrodes, the liquid crystal molecules are arranged in a manner of being almost completely arranged in parallel along an electric field direction. Therefore, a polarization direction of light passing through one of polarization filters does not rotate, and therefore the light is completely blocked. In this case, the pixels look black. A twisting degree of arrangement of the liquid crystal molecules can be controlled by means of voltage control, so as to achieve different grayscales.

Because liquid crystals do not have colors themselves, a color filter is used to generate various colors, and is a key component, for turning grayscales into colors, of an LCD. A backlight module in the LCD provides a light source, and then grayscale display is formed by means of a drive IC and liquid crystal control, and the light source passes through a color resist layer of the color filter to form a color display image.

SUMMARY

To resolve the foregoing technical problem, an objective of this application is to provide a method for designing a display panel, and in particular, to a method for driving a display apparatus, including: calculating average signals of sub pixel units in a zone to obtain a zone first average signal, a zone second average signal, and a zone third average signal; first performing second gamma adjustment according to grayscale corresponding predefined ranges of the first, second, and third average signals; allowing a second luminance ratio in a large viewing angle less than first and third luminance ratios in the large viewing angle, presenting a neutral color; and adjusting luminance of a corresponding second light source.

The objective of this application may further be achieved and the technical problem of this application may further be resolved by using the following technical solutions.

Another objective of this application is to provide an apparatus for driving a display apparatus, including at least one zone, where each zone is formed by a plurality of pixel units, each pixel unit is formed by a first sub pixel unit, a second sub pixel unit, and a third sub pixel unit, and includes: calculating average signals of sub pixel units in a zone to obtain a zone first average signal, a zone second average signal, and a zone third average signal; first performing second gamma adjustment according to grayscale corresponding predefined ranges of the first, second, and third average signals; and adjusting luminance of a corresponding second light source.

Still another objective of this application is to provide a display apparatus, including a display apparatus and the foregoing apparatus for driving a display apparatus. The drive apparatus is connected to the display panel, and transmits an image signal to the display panel.

In an embodiment of this application, according to the method, regarding grayscales of the average signals, when a grayscale of the zone second average signal is a first value grayscale in a predefined range, and grayscales of the zone first average signal and the zone third average signal are a second value grayscale in a predefined range, second gamma (γ) is adjusted from original $\gamma^G$ to $\gamma^{G1}$, where $\gamma^{G1}>\gamma^G$.

In an embodiment of this application, according to the method, the first value grayscale and the second value grayscale in the predefined ranges are selected from the following groups: a first group: when the first value grayscale is in a range of 255 to 200, the second value grayscale is less than 200; a second group: when the first value grayscale is in a range of 200 to 150, the second value grayscale is in a range of 150 to 200; a third group: when the first value grayscale is in a range of 150 to 100, the second value grayscale is in a range of 100 to 150; a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

In an embodiment of this application, according to the method, the second gamma is adjusted, so that luminance corresponding to a second grayscale decreases and a luminance decrease calculation formula is $L'G(g)=LG(255)*(g/255)^{\gamma G1}$, where grayscale g represents any grayscale.

In an embodiment of this application, according to the method, a calculation formula for adjusting the luminance of the corresponding second light source is: $A'n,m_G/An,m_G=LG(Ave_G_{n,m})/L'G(Ave_G_{n,m})=LG(255)*(Ave_G_{n,m}/255)^{\gamma G}/LG(255)*(Ave_Gn,m/255)^{\gamma G1}$, where A'n,m_G is an adjusted second light source luminance signal, An,m_G is an initial second light source luminance signal, Ave_Gn,m is a calculated average signal of all second sub pixel units in the zone, and n and m are a column and a row where the zone is located.

In an embodiment of this application, according to the structure, regarding grayscales of the average signals, when a grayscale of the zone second average signal is a first value grayscale in a predefined range, and grayscales of the zone first average signal and the zone third average signal are a second value grayscale in a predefined range, second gamma (γ) is adjusted from original $\gamma^G$ to $\gamma^{G1}$, where $\gamma^{G1}>\gamma^G$.

In an embodiment of this application, according to the structure, the first value grayscale and the second value grayscale in the predefined ranges are selected from the following groups: a first group: when the first value grayscale is in a range of 255 to 200, the second value grayscale is less than 200; a second group: when the first value grayscale is in a range of 200 to 150, the second value grayscale is in a range of 150 to 200; a third group: when the first value grayscale is in a range of 150 to 100, the second value grayscale is in a range of 100 to 150; a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

In an embodiment of this application, according to the structure, a calculation formula for adjusting the luminance of the corresponding second light source is: $A'n,m_G/An,m_G=LG(Ave_G_{n,m})/L'G(Ave_G_{n,m})=LG(255)*(Ave_G_{n,m}/255)^{\gamma G}/LG(255)*(Ave_Gn,m/255)^{\gamma G1}$, where A'n,m_G is an adjusted second light source luminance signal, An,m_G is an initial second light source luminance signal, Ave_Gn,m is a calculated average signal of all second sub pixel units in the zone, and n and m are a column and a row where the zone is located.

According to this application, a grayscale drive method for improving a color cast of a second hue in a large viewing angle is used, that is, a second input gamma signal is turned up by means of adjustment, so that a second luminance ratio in the large viewing angle is less than first and third luminance ratios in the large viewing angle, presenting a neutral color. The neutral color enables a color difference between the front viewing angle and the large viewing angle to be improved. Then, by means of luminance signal compensation of the second light source, colors viewed in front can be maintained the same as the original colors, and performance of the original colors is not affected by adjustment of the second gamma signal. Color brightness of the second color in the large viewing angle can be improved while performance of an original color signal can be maintained.

DETAILED DESCRIPTION

Figure 1:
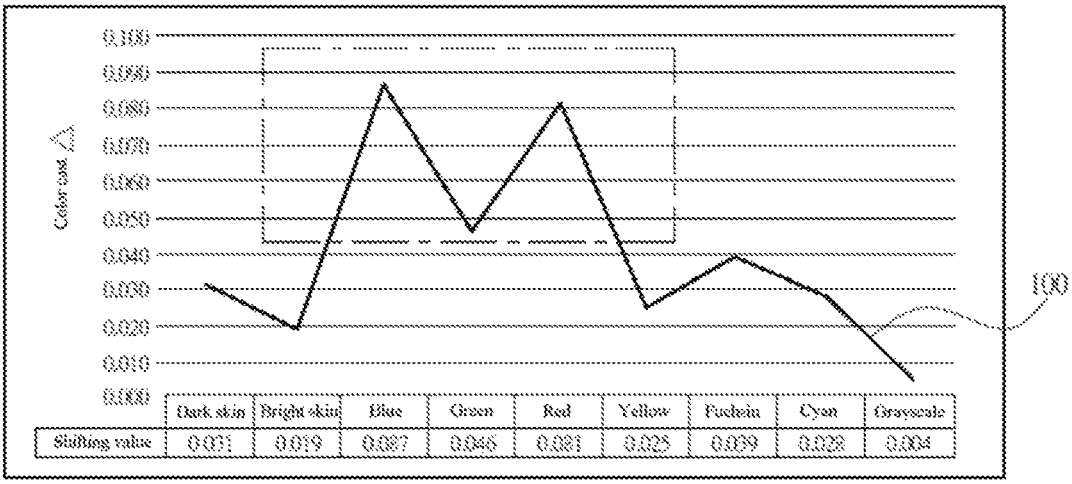
FIG. 1 is a diagram of a relationship between a color system and a color cast of an exemplary LCD before color cast adjustment.

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by a same reference number. In addition, for understanding and ease of description, the size and the thickness of each component shown in the accompanying drawings are randomly shown, but this application is not limited thereto.

In the accompanying drawings, for clarity, thicknesses of a layer, a film, a panel, an area, and the like are enlarged. In the accompanying drawings, for understanding and ease of description, thicknesses of some layers and areas are enlarged. It should be understood that, for example, when a component such as a layer, a film, an area, or a base is described to be "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout this specification, "on" means that one is located above or below a target component and does not necessarily mean that one is located on the top based on a gravity direction.

To further describe technical means used in this application to achieve a preset inventive objective and technical effects of this application, specific implementations, structures, features, and effects of a method and an apparatus for driving a display apparatus and a display apparatus provided according to this application are described in detail below with reference to the accompanying drawings and preferred embodiments.

The display apparatus of this application includes a display panel and a backlight module disposed opposite to each other. The display panel mainly includes a color filter substrate, an active array substrate, and a liquid crystal layer sandwiched between the two substrates. The color filter substrate, the active array substrate, and the liquid crystal layer may form a plurality of pixel units disposed in an array. The backlight module may emit light rays penetrating through the display panel, and display colors by using each pixel unit of the display panel, to form an image.

In an embodiment, the display panel of this application may be a curved-surface display panel, and the display apparatus of this application may also be a curved-surface display apparatus.

Currently, in improvement of a wide viewing angle technology of a vertical alignment (VA) display panel, manufacturers of display apparatuses have developed a photo-alignment technology to control an alignment direction of liquid crystal molecules, thereby improving the optical performance and the yield of a display panel. The photo-alignment technology is to form multi-domain alignment in each pixel unit of a panel, so that liquid crystal molecules in a pixel unit tilt towards, for example, four different directions. The photo-alignment technology is to irradiate a polymer thin film (an alignment layer) of a color filter substrate or a thin film transistor substrate by using an ultraviolet light source (for example, polarized light), so that polymer structures on a surface of the thin film undergo non-homogeneous photopolymerization, isomerization, or pyrolysis, inducing chemical bond structures on the surface of the thin film to generate special directivities, so as to further induce forward arrangement of liquid crystal molecules, thereby achieving the objective of photo-alignment.

According to different orientation manners of liquid crystals, currently, display panels on a mainstream market may be divided into the following types: a VA type, a TN or super twisted nematic (STN) type, an in-plane switching (IPS) type, and a fringe field switching (FFS) type. Displays in a VA mode include, for example, a patterned vertical alignment (PVA) display or a multi-domain vertical alignment (MVA) display apparatus. The PVA display achieves a wide viewing angle effect by using a fringing field effect and a compensation plate. The MVA display apparatus divides one pixel into a plurality of areas, and makes, by using a protrusion or a particular pattern structure, liquid crystal molecules in different areas tilt towards different directions, to achieve a wide viewing angle and improve the transmittance. In an IPS mode or an FFS mode, an electric field including components approximately parallel to a substrate is applied, so that liquid crystal molecules make responses in a direction parallel to a plane of the substrate and are driven. An IPS display panel and an FFS display panel have advantages of wide viewing angles.

In some embodiments, a first hue is a red hue, a second hue is a green hue, and a third hue is a blue hue. Correspondingly, first, second, and third grayscale signals are red, green, and blue grayscale signals, and first, second, and third average signals are red, green, and blue average signals. Other expressions related to "first, second, and third" in embodiments indicate same meanings by analogy.

FIG. 1 is a diagram of a relationship between a color system and a color cast of an exemplary LCD before color cast adjustment. Referring to FIG. 1, in an LCD, due to correlation between a refractive index and a wavelength and correlation between transmittances and phase delays of different wavelengths, transmittances have different performances according to different wavelengths, and with drive of a voltage, phase delays of different wavelengths also make changes of different degrees, affecting performances of transmittances of different wavelengths. FIG. 1 shows changes of color casts, between a large viewing angle and a front viewing angle, of various representative color systems of an LCD. It can be obviously found that conditions of color casts 100, in a large viewing angle, of color systems biased to first, second, and third hues are all more severe than those of other color systems. Therefore, overcoming color cast defects of the first, second, and third hues can greatly improve an overall color cast in the large viewing angle.

Figure 2:
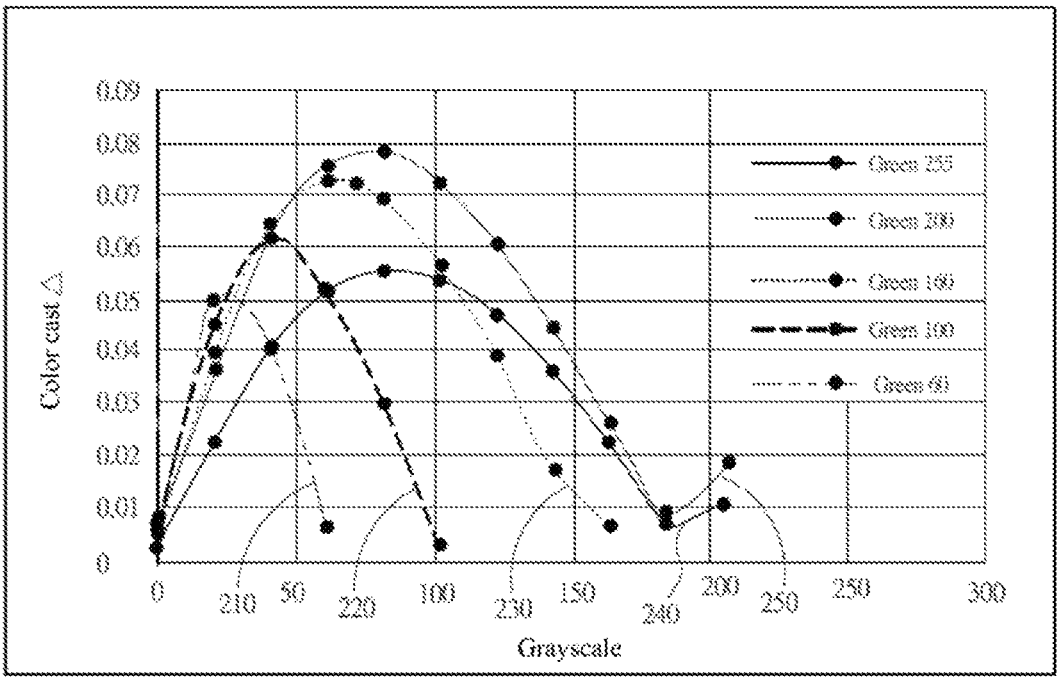
FIG. 2 is a diagram of a relationship between a second color cast and a grayscale of an LCD before color cast adjustment according to an embodiment of this application.
Figure 3:
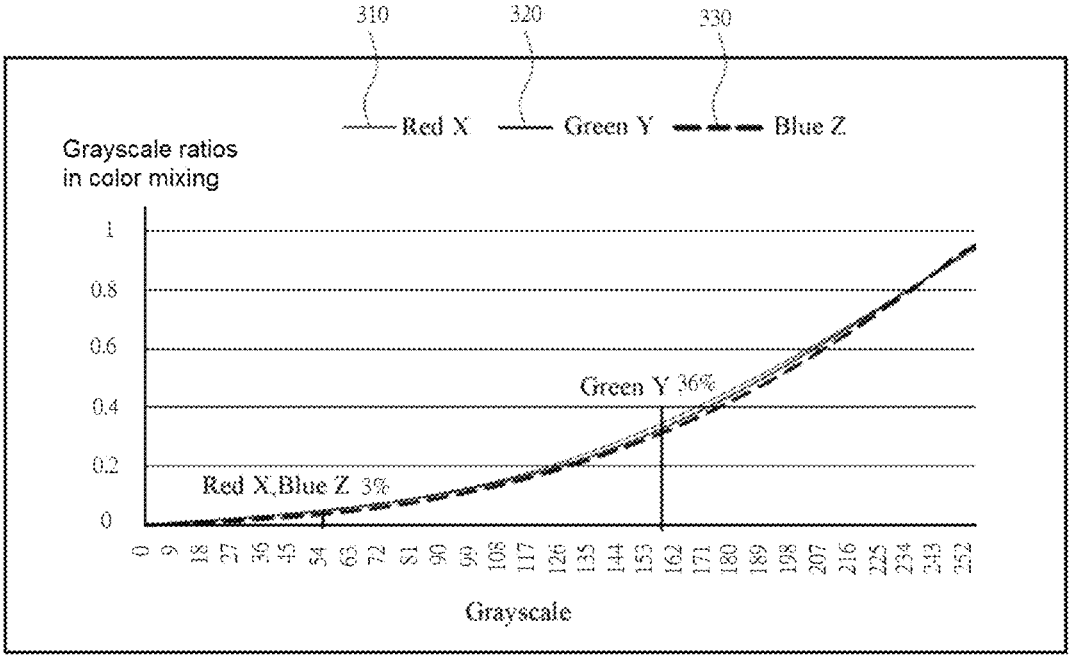
FIG. 3 is a diagram of a relationship between first red X, second green Y, and third blue Z and a grayscale in a front viewing angle of an LCD before color cast adjustment according to an embodiment of this application.
Figure 4:
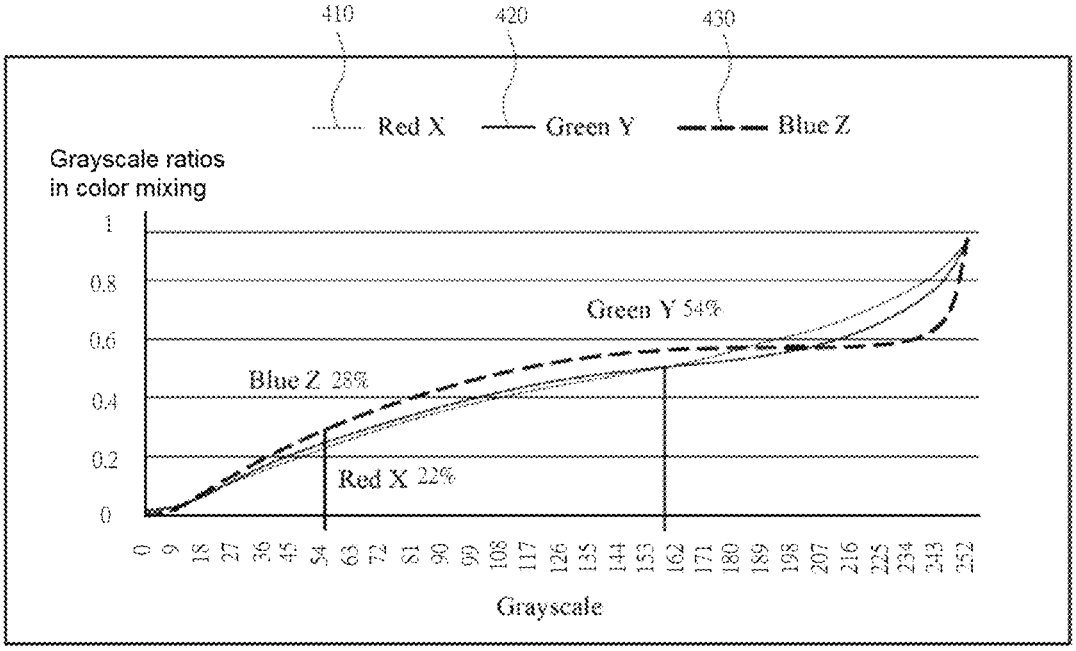
FIG. 4 is a diagram of a relationship between first red X, second green Y, and third blue Z and a grayscale in a large viewing angle of an LCD before color cast adjustment according to an embodiment of this application.

FIG. 2 is a diagram of a relationship between a second color cast and a grayscale of an LCD before color cast adjustment according to an embodiment of this application. FIG. 3 is a diagram of a relationship between first red X, second green Y, and third blue Z and a grayscale in a front viewing angle of an LCD before color cast adjustment according to an embodiment of this application. FIG. 4 is a diagram of a relationship between first red X, second green Y, and third blue Z and a grayscale in a large viewing angle of an LCD before color cast adjustment according to an embodiment of this application. Referring to FIG. 2, FIG. 2 shows viewing angle color difference change conditions in a front viewing angle and a 60-degree horizontal viewing angle under different color mixing conditions of a second color system. When a second (Green; G) grayscale (Gray) is 255, the curve is 240, and first (Red; R) and third (Blue; B) grayscales are in a range of 20 to 180. Lower first and third grayscale signals indicate a severe color cast of the second hue. When the second grayscale is 200, the curve is 250, and the first and third grayscales are in a range of 10 to 180. Lower first and third grayscale signals indicate a severe color cast of the second hue. When the second grayscale is 160, the curve is 230, and the first and third grayscales are in a range of 10 to 140. Lower first and third grayscale signals indicate a severe color cast of the second hue. When the second grayscale is 100, the curve is 220, and the first and third grayscales are in a range of 10 to 80. Lower first and third grayscale signals indicate a severe color cast of the second hue.

Refer to FIG. 3, FIG. 4, and the following descriptions for a color cast. For example, when color mixing grayscales in a front viewing angle are a first grayscale 50, a second grayscale 160, and a third grayscale 50, grayscale ratios of red X, green Y, blue Z to full-grayscale first 255, second 255, and third 255 in the corresponding front viewing angle are 3%, 36%, and 3% in color mixing (310, 320, 330). Grayscale ratios of red X, green Y, and blue Z to full-grayscale first 255, second 255, and third 255 in a corresponding large viewing angle are 22%, 54%, and 28% in color mixing (410, 420, 430). Color mixing ratios of red X, green Y, and blue Z in the front viewing angle are different from those of red X, green Y, and blue Z in the large viewing angle. Consequently, luminance ratios of red X and blue Z to green Y in the original front viewing angle are considerably small, and luminance ratios of red X and blue Z to green Y in the large viewing angle are non-neglectable. Therefore, a second hue in the large viewing angle is not as bright as that in the front viewing angle, and has an obvious color cast.

Figure 5:
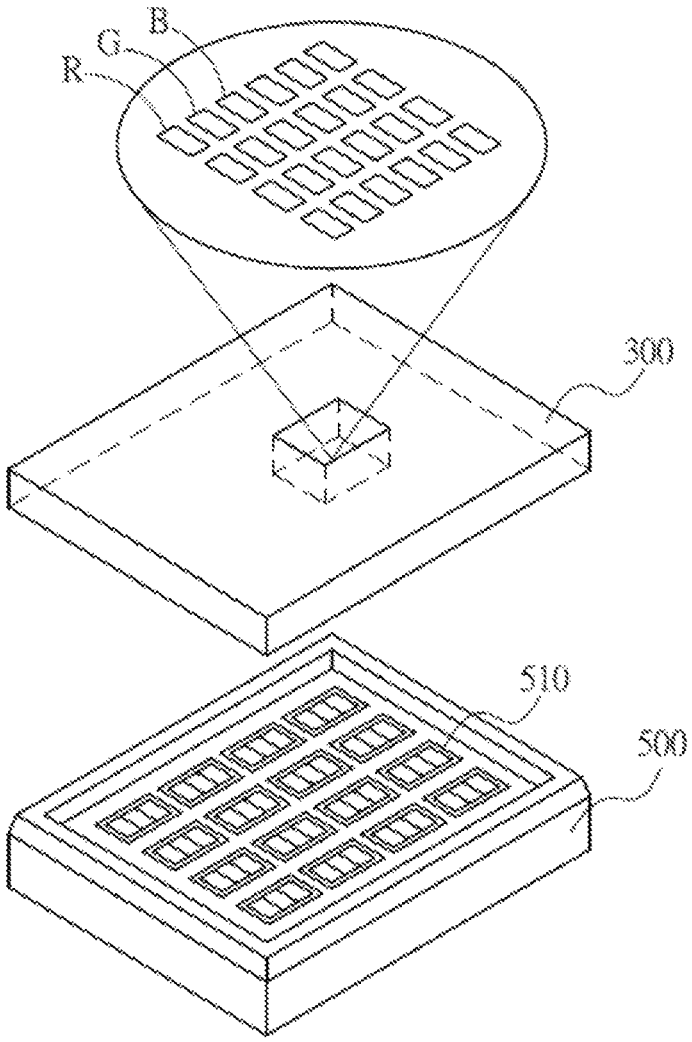
FIG. 5 is a schematic diagram of an apparatus for driving a display apparatus according to an embodiment of this application.
Figure 6:
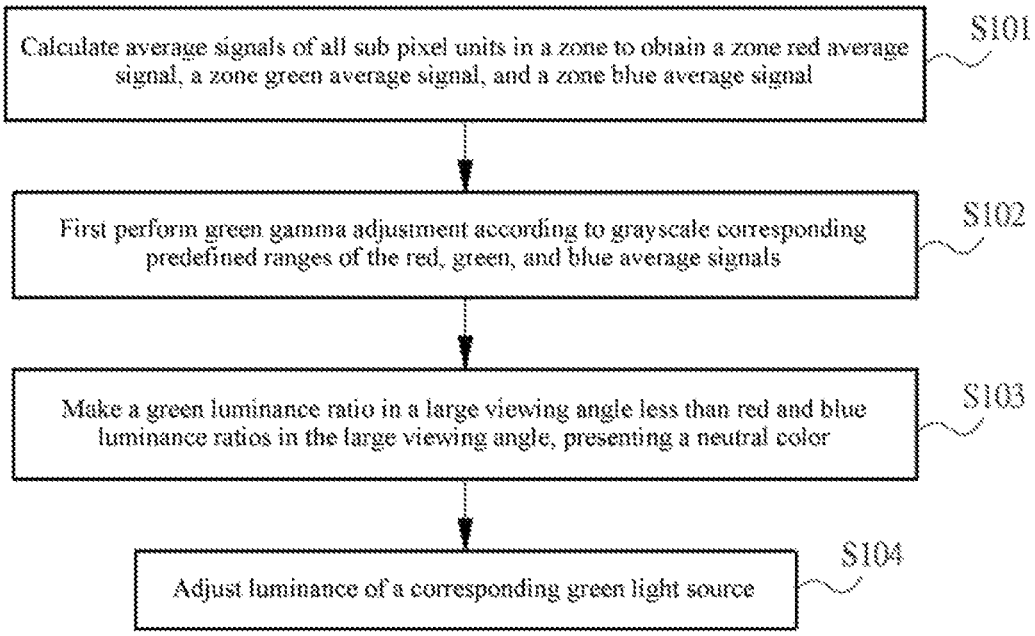
FIG. 6 is a flowchart for describing a method for driving a display apparatus according to an embodiment of this application.

FIG. 5 is a schematic diagram of an apparatus for driving a display apparatus according to an embodiment of this application and FIG. 6 is a flowchart for describing a method for driving a display apparatus according to an embodiment of this application. Referring to FIG. 5, according to an embodiment of this application, an apparatus 500 for driving a display apparatus includes a plurality of first, second, and third sub pixels, that is, red, green, and blue sub pixels. Each group of red, green, and blue sub pixels is referred to as a pixel unit 510. Each pixel unit represents an image signal. In this application, an LCD is divided into a plurality of zones. Each zone 300 is formed by a plurality of pixel units. The size of the zone may be self-defined. The LCD may be divided into columns*rows (N*M), and a plurality of zones 300 formed by pixel units 510.

In the apparatus for driving a display apparatus of this application, a zone first average signal, a zone second average signal, and a zone third average signal are obtained by calculating average signals of sub pixel units in a zone, and then second gamma adjustment is first performed according to grayscale corresponding predefined ranges of the zone first, second, and third average signals, and luminance of a corresponding second light source is adjusted, so that correctness of viewing colors in front can be maintained and defects of viewing angle color casts can be overcome. Second gamma is green gamma. For example, the zone first average signal, the zone second average signal, and the zone third average signal can be a zone first color average signal, a zone second color average signal, and a zone third color average signal, respectively. The second gamma can be second color gamma. The second light source can be second color light source.

Referring to FIG. 5, in an embodiment, an apparatus 500 for driving a display apparatus includes at least one zone 300. Each zone 300 is formed by a plurality of pixel units 510. Each pixel unit 510 is formed by a first sub pixel unit, a second sub pixel unit, and a third sub pixel unit, and includes: calculating average signals of sub pixel units in a zone 300 to obtain a zone first average signal, a zone second average signal, and a zone third average signal; first performing second gamma adjustment according to grayscale corresponding predefined ranges of the first, second, and third average signals; and adjusting luminance of a corresponding second light source.

In an embodiment, regarding grayscales of the average signals, when a grayscale of the zone second average signal is a first value grayscale in a predefined range, and grayscales of the zone first average signal and the zone third average signal are a second value grayscale in a predefined range, second gamma (γ) is adjusted from original $\gamma^G$ to $\gamma^{G1}$ where $\gamma^{G1}>\gamma^G$.

In an embodiment, the first value grayscale and the second value grayscale in the predefined ranges are selected from the following groups: a first group: when the first value grayscale is in a range of 255 to 200, the second value grayscale is less than 200; a second group: when the first value grayscale is in a range of 200 to 150, the second value grayscale is in a range of 150 to 200; a third group: when the first value grayscale is in a range of 150 to 100, the second value grayscale is in a range of 100 to 150; a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

In an embodiment, a calculation formula for adjusting the luminance of the corresponding second light source is: $A'n,m_G/An,m_G=LG(Ave_G_{n,m})/L'G(Ave_G_{n,m})=LG(255)*(Ave_G_{n,m}/255)^{\gamma G}/LG(255)*(Ave_Gn,m/255)^{\gamma G1}$, where A'n,m_G is an adjusted second light source luminance signal, An,m_G is an initial second light source luminance signal, Ave_Gn,m is a calculated average signal of all second sub pixel units in the zone, and n and m are a column and a row where the zone is located. The following steps are performed:

calculating average signals of sub pixel units in a zone to obtain a zone first average signal, a zone second average signal, and a zone third average signal;

first performing second gamma adjustment according to grayscale corresponding predefined ranges of the first, second, and third average signals;

allowing a second luminance ratio in a large viewing angle less than first and third luminance ratios in the large viewing angle, presenting a neutral color, wherein the first, second and third luminance ratios can be first, second and third color luminance ratios, respectively; and.

adjusting luminance of a corresponding second light source.

Referring to FIG. 6, FIG. 6 shows the following flows: flow S101: Calculate average signals of sub pixel units (Rn,m_ij, Gn,m_ij, and Bn,m_ij) in a zone (n, m) to obtain a zone first average signal (Ave_Rn,m), a zone second average signal (Ave_Gn,m), and a zone third average signal (Ave_Bn,m), where i and j are pixel units in the n,m zone;

flow S102: First perform second gamma adjustment according to grayscale corresponding predefined ranges of the first, second, and third average signals;

flow S103: Allow a second luminance ratio in a large viewing angle less than first and third luminance ratios in the large viewing angle, presenting a neutral color; and flow S104: Adjust luminance of a corresponding second light source.

In an embodiment, the grayscale corresponding predefined ranges of the first, second, and third average signals in flow S102 are: when a grayscale of the zone second average signal is in a predefined range of 255 to 200, and grayscales of the zone first average signal and the zone third average signal are in a predefined range of being less than 200, second gamma (γ) is adjusted from original $\gamma^G$ to $\gamma^{G1}$, where $\gamma^{G1}>\gamma^G$.

In an embodiment, the grayscale corresponding predefined ranges of the first, second, and third average signals in flow S102 are: when a grayscale of the zone second average signal is in a predefined range of 200 to 150, and the grayscales of the zone first average signal and the zone third average signal are in a predefined range of 150 to 200, second gamma (γ) is adjusted from the original $\gamma^G$ to $\gamma^{G1}$, where $\gamma^{G1}>\gamma^G$.

In an embodiment, the grayscale corresponding predefined ranges of the first, second, and third average signals in flow S102 are: when a grayscale of the zone second average signal is in a predefined range of 150 to 100, and the grayscales of the zone first average signal and the zone third average signal are in a predefined range of 100 to 150, second gamma (γ) is adjusted from the original $\gamma^G$ to $\gamma^{G1}$, where $\gamma^{G1}>\gamma^G$.

In an embodiment, the grayscale corresponding predefined ranges of the first, second, and third average signals in flow S102 are: when a grayscale of the zone second average signal is in a predefined range of 100 to 50, and the grayscales of the zone first average signal and the zone third average signal are in a predefined range of 50 to 100, second gamma (γ) is adjusted from the original $\gamma^G$ to $\gamma^{G1}$, where $\gamma^{G1}>\gamma^G$.

In an embodiment, the grayscale corresponding predefined ranges of the first, second, and third average signals in flow S102 are: when a grayscale of the zone second average signal is in a predefined range of 50 to 0, and the grayscales of the zone first average signal and the zone third average signal are in a predefined range of 0 to 50, second gamma (γ) is adjusted from the original $\gamma^G$ to $\gamma^{G1}$, where $\gamma^{G1}>\gamma^G$.

In the foregoing embodiments, after adjustment, the second gamma is improved, making luminance corresponding to a second grayscale decrease. A luminance decrease calculation formula is as follows: $L'G(g)=LG(255)*(g/255)\gamma^{G1}$, less than $LG(g)=LG(255)*(g/255)\gamma^G$, where grayscale g represents any grayscale.

Refer to FIG. 5 and FIG. 6. An embodiment of this application describes a method for driving a display apparatus. When this invention uses backlight of a direct type LED, the backlight is divided into a plurality of zones of columns (N)*rows (M) like a display. Each zone (n,m) has independent first, second, and third LED light sources. Initial luminance signals of first, second, and third LEDs in the zone (n,m) are An,m_R, An,m_G, and An,m_B. To compensate for luminance decease to L'G(g)=LG(255)*(g/255)$\gamma^{G1}$<LG(g) LG(255)*(g/255)$\gamma^{G}$, caused by adjusting the second gamma from original $\gamma^{G}$ to $\gamma^{G1}$, where $\gamma$ a luminance signal of the second LED of the zone is adjusted to increase to A'n,m_G. A calculation formula of a luminance increase ratio of green (G) is: A'n,m_G/An,m_G=LG(Ave_Gn,m)/L'G(Ave_Gn,m)=LG(255)*(Ave_Gn,m/255)$\gamma^{G}$/LG(255)*(Ave_Gn,m/255)$\gamma^{G1}$. In this embodiment, by means of luminance signal compensation of the second LED, colors viewed in front can be maintained the same as the original colors, and performance of the original colors is not affected by adjustment of the second gamma signal.

Referring to FIG. 5, in an embodiment, an apparatus 500 for driving a display apparatus includes at least one zone 300. Each zone 300 is formed by a plurality of pixel units 510. Each pixel unit 510 is formed by a first sub pixel unit, a second sub pixel unit, and a third sub pixel unit, and further includes: calculating average signals of sub pixel units in a zone 300 to obtain a zone first average signal, a zone second average signal, and a zone third average signal; first performing second gamma adjustment according to grayscale corresponding predefined ranges of the first, second, and third average signals; and adjusting luminance of a corresponding second light source. Regarding grayscales of the average signals, when a grayscale of the zone second average signal is a first value grayscale in a predefined range, and grayscales of the zone first average signal and the zone third average signal are a second value grayscale in a predefined range, second gamma ($\gamma$) is adjusted from original $\gamma^{G}$ to $\gamma^{G1}$, where $\gamma^{G1}>\gamma^{G}$. The first value grayscale and the second value grayscale in the predefined ranges are selected from the following groups: a first group: when the first value grayscale is in a range of 255 to 200, the second value grayscale is less than 200; a second group: when the first value grayscale is in a range of 200 to 150, the second value grayscale is in a range of 150 to 200; a third group: when the first value grayscale is in a range of 150 to 100, the second value grayscale is in a range of 100 to 150; a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50. The first sub pixel unit, the second sub pixel unit, and the third sub pixel unit are arranged in an array.

Referring to FIG. 2, in an embodiment, when a same second hue corresponds to same first and third grayscale signals, a lower color mixing second signal indicates a smaller color difference. As shown in FIG. 2, when a second grayscale signal is 200, that is, a curve 250, and first and third color mixing grayscale signals are 100, a color difference is 0.07; when the second grayscale signal is 160, that is, a curve 230, and the first and third color mixing grayscale signals are 100, the color difference is 0.055; and when the second grayscale signal is 100, that is, a curve 220, and the first and third color mixing grayscale signals are 100, the color difference is 0.003. Therefore, according to this application, the second grayscale signal is reduced, so that the second grayscale signal is approximate to the first and third color mixing grayscale signals, and the overall color is biased to a neutral black and white grayscale color, reducing a color cast in a large viewing angle. Because the overall mixed color is biased to a neutral black and white grayscale color, to maintain correct color mixing image quality, a luminance signal of the second LED is increased, so that a second hue signal obtained by means of overall front viewing can be maintained, thereby maintaining original second hue image quality.

Figure 7:
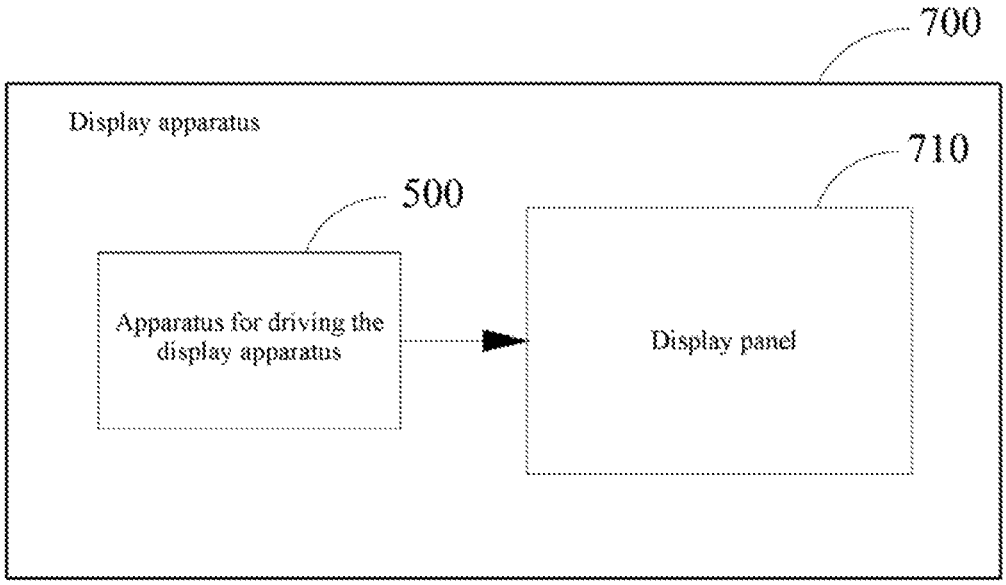
FIG. 7 is a modules diagram of a display panel according to an embodiment of this application.

FIG. 7 is a modules diagram of a display panel according to an embodiment of this application. A display apparatus 700 includes an apparatus 500 for driving the display apparatus and a display panel 710. The apparatus 50 for driving the display apparatus is connected to the display panel 710, and transmits an image signal to the display panel 710.

According to this application, a grayscale drive method for improving a color cast of a second hue in a large viewing angle is used, that is, a second input gamma signal is turned up by means of adjustment, so that a second luminance ratio in the large viewing angle is less than first and third luminance ratios in the large viewing angle, presenting a neutral color. The neutral color enables a color difference between the front viewing angle and the large viewing angle to be improved. Then, by means of luminance signal compensation of the second light source, colors viewed in front can be maintained the same as the original colors, and performance of the original colors is not affected by adjustment of the second gamma signal. Color brightness of the second color in the large viewing angle can be improved while performance of an original color signal can be maintained.

Phrases such as "in some embodiments" and "in various embodiments" are repeatedly used. The wordings usually refer to different embodiments, but they may also refer to a same embodiment. Words, such as "comprise", "have", and "include" are synonyms, unless other meanings are indicated in the context.

The foregoing descriptions are merely embodiments of this application, and are not intended to limit this application in any form. Although this application has been disclosed above through the embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A method for driving a display apparatus, comprising:

calculating average signals of sub pixel units in a zone to obtain a zone first color average signal, a zone second color average signal, and a zone third color average signal;

first performing second color gamma adjustment according to grayscale corresponding predefined ranges of the zone first, second, and third color average signals;

allowing a second color luminance ratio at a large viewing angle less than first and third color luminance ratios at the large viewing angle; and adjusting luminance of a corresponding second color light source;

wherein regarding grayscales of the average signals, when a grayscale of the zone second color average signal is a first value grayscale in a predefined range, and grayscales of the zone first color average signal and the zone third color average signal are a second value grayscale in a predefined range, second color gamma (γ) is adjusted from original $\gamma^G$ to $\gamma^{G1}$, where $\gamma^{G1}>\gamma^G$.

2. The method for driving a display apparatus according to claim 1, wherein the first value grayscale and the second value grayscale in the predefined ranges are selected from the following groups:

a first group: when the first value grayscale is in a range of 255 to 200, the second value grayscale is less than 200;

a second group: when the first value grayscale is in a range of 200 to 150, the second value grayscale is in a range of 150 to 200;

a third group: when the first value grayscale is in a range of 150 to 100, the second value grayscale is in a range of 100 to 150;

a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

3. The method for driving a display apparatus according to claim 1, wherein a calculation formula for adjusting the luminance of the corresponding second color light source is:

$$A'n,m_G/An,m_G=LG(\text{Ave_}G_{n,m})/L'G(\text{Ave_}G_{n,m})=LG(255)*(\text{Ave_}G_{n,m}/255)^{\gamma G}/LG(255)*(\text{Ave_}Gn,m/255)^{\gamma G1},\text{ where}$$

A'n,m_G is an adjusted second light source luminance signal, An,m_G is an initial second light source luminance signal, Ave_Gn,m is a calculated average signal of all second sub pixel units in the zone, and n and m are a column and a row where the zone is located.

4. The method for driving a display apparatus according to claim 1, wherein the second color gamma is adjusted, so that luminance corresponding to a second grayscale decreases and a luminance decrease calculation formula is:

$$L'G(g)=LG(255)*(g/255)\gamma G1.$$

5. The method for driving a display apparatus according to claim 4, wherein grayscale g represents any grayscale.

6. An apparatus for driving a display apparatus, comprising at least one zone, wherein each zone is formed by a plurality of pixel units, each pixel unit is formed by a first sub pixel unit, a second sub pixel unit, and a third sub pixel unit, and comprises: calculating average signals of sub pixel units in a zone to obtain a zone first color average signal, a zone second color average signal, and a zone third color average signal; first performing second color gamma adjustment according to grayscale corresponding predefined ranges of the zone first, second, and third color average signals; and adjusting luminance of a corresponding second color light source;

wherein regarding grayscales of the average signals, when a grayscale of the zone second color average signal is a first value grayscale in a predefined range, and grayscales of the zone first color average signal and the zone third color average signal are a second value grayscale in a predefined range, second color gamma (γ) is adjusted from original $\gamma^G$ to $\gamma^{G1}$, where $\gamma^{G1}>\gamma^G$.

7. The apparatus for driving a display apparatus according to claim 6, wherein the first value grayscale and the second value grayscale in the predefined ranges are selected from the following groups:

a first group: when the first value grayscale is in a range of 255 to 200, the second value grayscale is less than 200;

a second group: when the first value grayscale is in a range of 200 to 150, the second value grayscale is in a range of 150 to 200;

a third group: when the first value grayscale is in a range of 150 to 100, the second value grayscale is in a range of 100 to 150;

a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

8. The apparatus for driving a display apparatus according to claim 6, wherein a calculation formula for adjusting the luminance of the corresponding second color light source is:

$$A'n,m_G/An,m_G=LG(\text{Ave_}G_{n,m})/L'G(\text{Ave_}G_{n,m})=LG(255)*(\text{Ave_}G_{n,m}/255)^{\gamma G}/LG(255)*(\text{Ave_}Gn,m/255)^{\gamma G1},\text{ where}$$

A'n,m_G is an adjusted second light source luminance signal, An,m_G is an initial second light source luminance signal, Ave_Gn,m is a calculated average signal of all second sub pixel units in the zone, and n and m are a column and a row where the zone is located.

9. The apparatus for driving a display apparatus according to claim 6, wherein the second color gamma is adjusted, so that luminance corresponding to a second grayscale decreases and a luminance decrease calculation formula is $$L'G(g)=LG(255)*(g/255)\gamma G1.$$

10. The apparatus for driving a display apparatus according to claim 9, wherein grayscale g represents any grayscale.

11. A display apparatus, comprising a display panel;

a drive apparatus, comprising at least one zone, wherein each zone is formed by a plurality of pixel units, and each pixel unit is formed by a first sub pixel unit, a second sub pixel unit, and a third sub pixel unit, and comprising:

calculating average signals of sub pixel units in a zone to obtain a zone first average signal, a zone second average signal, and a zone third average signal;

first performing second color gamma adjustment according to grayscale corresponding predefined ranges of the zone first, second, and third average signals; and adjusting luminance of a corresponding second color light source;

wherein regarding grayscales of the average signals, when a grayscale of the zone second color average signal is a first value grayscale in a predefined range, and grayscales of the zone first color average signal and the zone third color average signal are a second value grayscale in a redefined range, second color gamma (γ) is adjusted from original $\gamma^G$ to $\gamma^{G1}$, where $\gamma^{G1}>\gamma^G$.

12. The display apparatus according to claim 11, wherein the first value grayscale and the second value grayscale in the predefined ranges are selected from the following groups:

a first group: when the first value grayscale is in a range of 255 to 200, the second value grayscale is less than 200;

a second group: when the first value grayscale is in a range of 200 to 150, the second value grayscale is in a range of 150 to 200;

a third group: when the first value grayscale is in a range of 150 to 100, the second value grayscale is in a range of 100 to 150;

a fourth group: when the first value grayscale is in a range of 100 to 50, the second value grayscale is in a range of 50 to 100; and a fifth group: when the first value grayscale is in a range of 50 to 0, the second value grayscale is in a range of 0 to 50.

13. The display apparatus according to claim 11, wherein a calculation formula for adjusting the luminance of the corresponding second color light source is:

$$A'n,m_G/An,m_G=LG(\text{Ave}_G_{n,m})/L'G(\text{Ave}_G_{n,m})=LG(255)*(\text{Ave}_G_{n,m}/255)^{\gamma G}/LG(255)*(\text{Ave}_Gn,m/255)^{\gamma G1}, \text{ where}$$

A'n,m_G is an adjusted second light source luminance signal, An,m_G is an initial second light source luminance signal, Ave_Gn,m is a calculated average signal of all second sub pixel units in the zone, and n and m are a column and a row where the zone is located.

14. The display apparatus according to claim 11, wherein the second color gamma is adjusted, so that luminance corresponding to a second grayscale decreases and a luminance decrease calculation formula is L'G(g)=LG(255)*(g/255)γG1.

15. The display apparatus according to claim 14, wherein grayscale g represents any grayscale.

16. The display apparatus according to claim 11, wherein the drive apparatus is connected to the display panel.

17. The display apparatus according to claim 16, wherein the drive apparatus transmits an image signal to the display panel.

* * * * *